US011975749B2

(12) United States Patent
Bleth et al.

(10) Patent No.: US 11,975,749 B2
(45) Date of Patent: May 7, 2024

(54) MOUNTING INTERFACE AND BUFFER SYSTEM FOR A RAIL VEHICLE

(71) Applicant: Siemens Mobility GmbH, Munich (DE)

(72) Inventors: Sebastian Bleth, Munich (DE); Jörg Melde, Olching (DE); Hannes Peer, Munich (DE); Jörg Pforr, Moosach (DE); Thomas Staudacher, Mering (DE)

(73) Assignee: Siemens Mobility GmbH, Munich (DE)

( * ) Notice: Subject to any disclaimer, the term of this patent is extended or adjusted under 35 U.S.C. 154(b) by 0 days.

(21) Appl. No.: 18/263,744

(22) PCT Filed: Dec. 6, 2021

(86) PCT No.: PCT/EP2021/084354
§ 371 (c)(1),
(2) Date: Aug. 1, 2023

(87) PCT Pub. No.: WO2022/161671
PCT Pub. Date: Aug. 4, 2022

(65) Prior Publication Data

US 2024/0034368 A1 Feb. 1, 2024

(30) Foreign Application Priority Data

Feb. 1, 2021 (DE) ..... 10 2021 200 865

(51) Int. Cl.
*B61G 11/18* (2006.01)
*B61G 11/16* (2006.01)

(52) U.S. Cl.
CPC ..... *B61G 11/18* (2013.01); *B61G 11/16* (2013.01)

(58) Field of Classification Search
CPC ..... B61G 11/00; B61G 11/02; B61G 11/08; B61G 11/16; B61G 11/18
See application file for complete search history.

(56) References Cited

FOREIGN PATENT DOCUMENTS

| | | | | |
|---|---|---|---|---|
| AT | 8339 | U1 | 6/2006 | |
| DE | 2931909 | A1 | 2/1981 | |
| DE | 8127634 | * | 9/1981 | ..... B61D 23/00 |
| DE | 8127634 | U1 | 12/1982 | |
| DE | 102013009121 | B3 | 7/2014 | |
| DE | 102018103844 | A1 | 8/2019 | |
| EP | 1914145 | A1 | 4/2008 | |
| GB | 17054 | A | 10/1910 | |

* cited by examiner

*Primary Examiner* — Robert J McCarry, Jr.
(74) *Attorney, Agent, or Firm* — Laurence A. Greenberg; Werner H. Stemer; Ralph E. Locher

(57) ABSTRACT

A mounting interface for attaching supporting components to a buffer of a rail vehicle. The interface has a mounting body with a component fastening region and an attachment region that is different therefrom. The component fastening region is equipped with fastening elements and/or holes for attaching the components. The attachment region is formed in such a way that it can be fastened to at least two fastening points at the rear side of a buffer flange using buffer screws. There is also described a buffer system and a rail vehicle with such a mounting interface.

20 Claims, 3 Drawing Sheets

MOUNTING INTERFACE AND BUFFER SYSTEM FOR A RAIL VEHICLE

FIELD AND BACKGROUND OF THE INVENTION

The invention relates to a mounting interface for attaching supporting components on a buffer of a rail vehicle, in particular steps, footplates, handles and/or platforms, preferably in the front-end region. In particular, the invention comprises a buffer system, e.g. an impact installation consisting of a crash element and a central-flange buffer, having such a mounting interface, e.g. a variable supplementary flange for further attachment parts, or for fastening a step to a crash element, in particular having a tear-off function.

In addition to the obligatory components for inter-operational compatibility, for various types of applications it is necessary to assemble also further attachment parts in the front-end region of rail vehicles. For example, possibilities which enable access to the external equipment of a vehicle, for example to windshields and wipers, and for changing from one side of the vehicle to the other, or a secure footing, e.g. steps, footplates, handles or switching platforms, are to be achieved.

The respective interfaces for assembling the front-end assembly usually are on the front plate of the undercarriage of the rail vehicle. For example, forward-protruding bracket constructions have to date been fastened to the front plate, these however having the disadvantage that they require or occupy a large amount of space. With a view to platforms, steps, handles or footplates, there is the additional aspect that the fastenings of these items have to be of such dimensions that the latter are not plastically deformed and elastically deformed only to a minor extent during use.

The fastening of platforms, steps, handles or footplates is in most instances performed unilaterally on one side of the vehicle body. Depending on the required width or depth of the footplate, the fastenings have to be of a correspondingly massive size in order to ensure minor elastic deformation. A massive and protruding fastening leads to an increase in weight and potentially to an increase in the complexity of assembling owing to poor accessibility, which is disadvantageous. Depending on the vehicle concept, this results in an additional complexity of assembling for adjustment work for compensating production tolerances between the different screw-fitment points.

Components for the irreversible absorption of energy between the vehicle body and the buffer are nowadays often assembled in the front or front-end region of rail vehicles. The absorption of energy here typically takes place in that the impact energy is converted into deformation energy by means of the above-mentioned crash elements (also referred to as "deformation elements" or "energy-absorption elements"). As opposed to the buffer, this conversion takes place by an irreversible deformation of the crash elements, which crumple axially.

While holders, for example for coupler handles, which have been welded to the crash element, are in some instances known in the prior art, such an attachment can be disadvantageous because a free and unencumbered deformation movement is required in order for these crash elements to function optimally, which must not be fundamentally compromised by handles, steps or footplates as well as their fastenings.

SUMMARY OF THE INVENTION

It is an object of the present invention to specify an alternative, more comfortable mounting interface for attaching elements in the front-end region of a rail vehicle, by way of which the disadvantages described above are avoided.

This object is achieved by a mounting interface as claimed, by a buffer system as claimed, as well as by a rail vehicle as claimed.

At the outset, it is noted for improved understanding of the following text that in terms of a buffer "rear" refers to the side which according to the intended use faces a rail vehicle, and "front" refers to the side of the buffer plate. In this way, if an item is attached to the "rear side" of the buffer flange, this means that said item is attached to the side of the buffer flange that faces away from the buffer plate, and would be disposed between the buffer flange and the fastening element (e.g. headstock or crash element) when the buffer is attached to a rail vehicle.

A mounting interface according to the invention for attaching supporting components to a buffer of a rail vehicle comprises a mounting body having a component-fastening region and an attachment region differing therefrom.

The mounting body of the mounting interface, which fundamentally per se represents also the mounting interface, thus comprises two different regions, one of which serving for fastening the supporting components, and the other one serving for attaching the mounting interface to the buffer. The term "supporting components" herein means components which are attached according to the intended use to an end of a rail vehicle and can support a load, in particular steps, footplates, handles, platforms or mountings.

The component-fastening region for this purpose is equipped with fastening elements and/or bores for attaching the respective supporting components for the rail vehicle. Fastening elements here are preferably bolts or screws which are already fixedly attached to the mounting body. Bores are preferably already provided with a thread so that a component can be simply screwed to the mounting body without inevitably having to use a nut (whereby such a nut can of course be used additionally for securing).

The attachment region is shaped such that said attachment region (in particular at at least three fastening points) can be fastened to the rear side of a buffer flange with buffer screws (typically commercially available screws), in particular with four screws. For example, said attachment region has the same shape as the buffer flange and at the corresponding locations has bores like the buffer flange, so that said attachment region conjointly with the buffer flange can be fastened by means of the buffer screws.

The attachment region can optionally have a recess in the center (e.g. advantageously in the case of a center flange buffer) such that said attachment region can encompass a buffer housing (i.e. a buffer sleeve or a buffer plunger) on the buffer flange.

A buffer flange (often also referred to as a "buffer (base) plate") is the plate by way of which a buffer is attached according to the intended use to a rail vehicle, or a crash element. The fastening of the buffer flange to the headstock of a rail vehicle, or to a crash element, is performed by screw-fitting the components by means of so-called "buffer screws". These buffer screws are well known; commercially available screws are typically used, which serve for securely connecting a buffer to a rail vehicle (or to a crash element).

A distinction is typically made between end flange buffers and center flange buffers. End flanges are attached to the end of a buffer sleeve, and center flanges are pushed onto a buffer housing, in particular the buffer sleeve of the latter, and attached in particular in the region of the center of the latter. As a result of the invention, the existing interface between the crash element or headstock and the buffer can be utilized so as to generate further interfaces for additional attachment parts, or else the buffer may be extended in length toward the front.

A buffer system according to the invention comprises a buffer, preferably a center flange buffer, with a buffer flange, and a mounting interface according to the invention which is attached to this buffer flange with buffer screws. The buffer system preferably additionally comprises a crash element which is attached to the buffer flange by means of buffer screws. The mounting interface here is preferably attached between the crash element and the buffer flange.

A rail vehicle according to the invention comprises a buffer system according to the invention. The rail vehicle is preferably a locomotive, in particular for switching purposes, or a car.

The invention has the particular advantage that an interface for fastening components, or attachment parts, which reach far forward in the longitudinal direction of the vehicle, or are to be positioned there, to a rail vehicle is made possible. Moreover, a certain degree of variability is provided by a corresponding design of the fastening elements, such that a conversion capability of the rail vehicle is provided.

By changing the fastening concept of the prior art, from an exclusive fastening to the car body and optionally to the front end to a fastening according to the invention to a buffer flange or to the buffer-proximal side of a crash element, the accessibility to the fastening points, and thus the complexity in assembling, can be reduced, and an element fastened in such a manner can potentially be embodied so as to be less massive owing to having better support, and weight can be reduced in this way. The respective element can of course also be additionally fastened to the car body.

Moreover, the complexity in adjusting and thus the complexity in assembling can be further reduced as a result of a more favorable tolerance chain by virtue of a reduced number of components with tolerances within the tolerance chain.

Further advantages of the construction include that no additional holders are required (with the exception of the potentially already existing fastening possibilities on the car body), and that there is no additional space requirement as a result. The attachment of the supporting components takes place on components which are present anyway, i.e. the buffer and optionally the crash element. The construction of the mounting interface here can be kept very simple and nevertheless extremely variable.

Further, particularly advantageous design embodiments and refinements of the invention are derived from the dependent claims as well as from the description hereunder, whereby the claims of one category of claims can be refined in a manner analogous to the claims and descriptive parts pertaining to another category of claims, and in particular individual features of different exemplary embodiments or variants can also be combined so as to form new exemplary embodiments or variants, respectively.

According to one preferred embodiment of the mounting interface, the attachment region has the same shape as a predetermined buffer flange or at least part of this buffer flange, and can be fastened conjointly with the buffer flange by means of predetermined buffer screws. This has the advantage that simple assembling and disassembling is possible (e.g. for a replacement with another mounting interface). To this end, a releasable fastening of the mounting interface, e.g. by means of the buffer screws, is very advantageous.

According to one preferred embodiment of the mounting interface, the attachment region has a recess (e.g. a bore) so that the attachment region can encompass a buffer housing (i.e. buffer sleeve or buffer plunger) of a predetermined buffer. In this way, a simple attachment of the mounting interface to a buffer is possible, even if the latter should be a center flange buffer. The attachment region here preferably corresponds to only part of the area of a buffer flange of a predetermined buffer, and comprises at least three bores for the buffer screws. Said attachment region preferably has a recess where a buffer housing is situated on the buffer flange.

According to one preferred embodiment of the mounting interface, the attachment region is angled, preferably orthogonally, relative to the component-fastening region. This serves for attaching a footplate, e.g. a horizontal standing surface, e.g. of a maintenance platform.

According to one preferred embodiment of the mounting interface, a fastening element is a bolt or a screw, and in the component-fastening region is fixedly attached to the mounting body. Alternatively or additionally, a fastening element is a bore in the component-fastening region, which is in particular provided with a thread.

One preferred embodiment of the mounting interface in the component-fastening region comprises fastening elements or bores conceived for attaching further attachment parts. These further attachment parts are preferably a coupler handle, a switchman's footplate, a switchman's platform, a maintenance platform, a railing and/or a handlebar.

According to one preferred mounting interface, the mounting body is shaped such that said mounting body between the component-fastening region and the attachment region has at least one (structural) weakening of the mounting body. This weakening here is designed such that the component-fastening region separates from the attachment region when a predetermined force acts on the weakening. The weakening here is preferably a predetermined breaking point, in particular in the form of a perforation or a shear-off element. This has the advantage that components can be mutually separated in a targeted manner in the event of an accident. For example, an unencumbered deformation movement of a crash element should be ensured at all times. For this purpose, the fastening of supporting components, e.g. of handles or footplates, on the buffer-proximal side of the crash element should fail in the event of an accident. This is achieved by said weakening which is, for example, a targeted weakening of the supporting cross-sectional area of the mounting body.

In this way, the mounting interface enables a user to attach additional attachment parts in a variable, space-saving manner but nevertheless with sufficient strength in the front-end region.

A preferred embodiment of the buffer system comprises a crash element which is attached to the buffer flange by means of buffer screws. The mounting interface here is attached between the crash element and the buffer flange.

According to one preferred embodiment of the buffer system, the buffer is a center flange buffer.

According to one preferred embodiment of the buffer system, the attachment region of the mounting interface is the same shape as the buffer flange (at least the contour, or potentially with the exception of a recess in the internal region), and at the corresponding locations has bores like the buffer flange. The mounting interface is preferably fastened to the buffer flange by means of the buffer screws, in particular between a crash element and the buffer flange.

According to one preferred embodiment of the buffer system, the attachment region of the mounting interface has a recess such that a buffer housing (i.e. buffer sleeve or buffer plunger) is at least partially encompassed, which is particularly advantageous in the case of an attachment to center flange buffers. The attachment region preferably corresponds to at least part of the area of the buffer flange, in particular the area of the latter with the exception of the recess, and the mounting interface is fastened to the buffer flange with at least three buffer screws.

The invention will be explained once again in more detail hereunder with reference to the appended figures and by means of exemplary embodiments. Identical components in the various figures are provided with identical reference signs. The figures are typically not true to scale. In the figures:

DETAILED DESCRIPTION OF THE INVENTION

Figure 1:
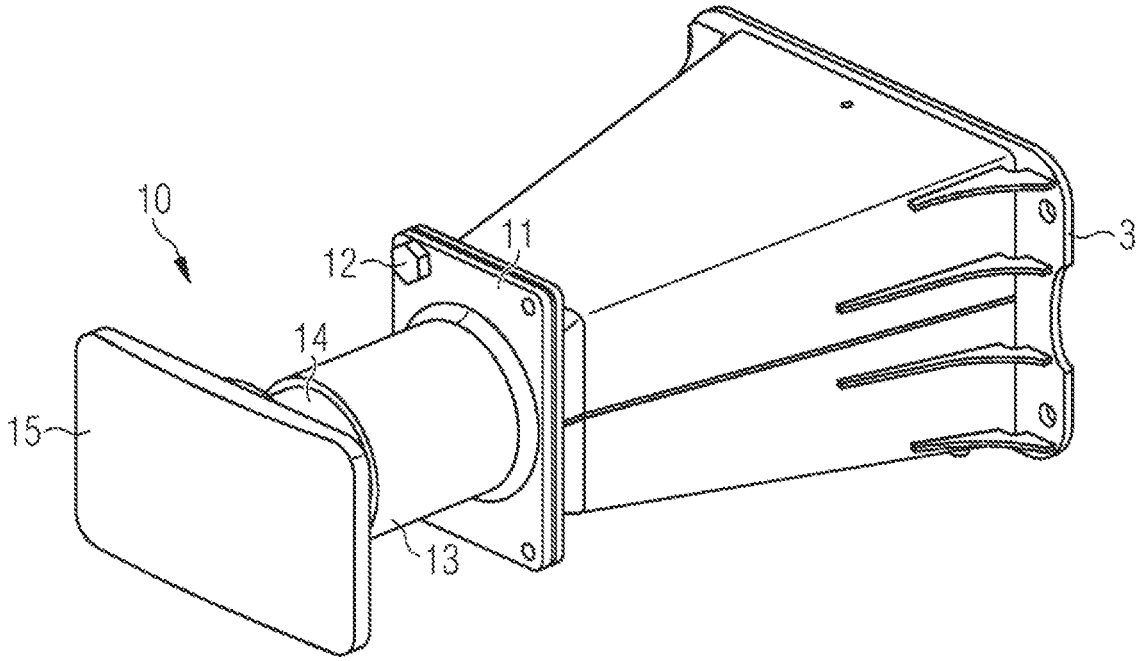
FIG 1 PRIOR ART
FIG. 1 shows a buffer according to the prior art.

FIG. 1 shows a buffer 10 according to the prior art. The buffer has a buffer flange 11 which may also be referred to as the "buffer base plate", and serves for fastening the buffer 10 to a headstock of a rail vehicle 4, or to a crash element 3 as illustrated here. The fastening of the buffer flange 11 is performed by means of buffer screws 12, of which only a single screw is illustrated here in order to also show the bores which for this purpose are present in the buffer flange 11 and the crash element 3.

The buffer sleeve 13 into which the buffer plunger 14 protrudes is welded to the buffer flange 11 here. An elastic buffer element, which is not visible here and can reversibly absorb and dissipate pressures that act on the buffer plate is incorporated between these two elements, whereby said elastic buffer element preferably can also convert some of the energy into heat and thus serves as a shock absorber. In the event of an accident in which much higher forces act than is normally the case, the crash element 3 serves for absorbing these forces. Said crash element 3 is deformed in the process and acts as a crumple zone.

Figure 2:
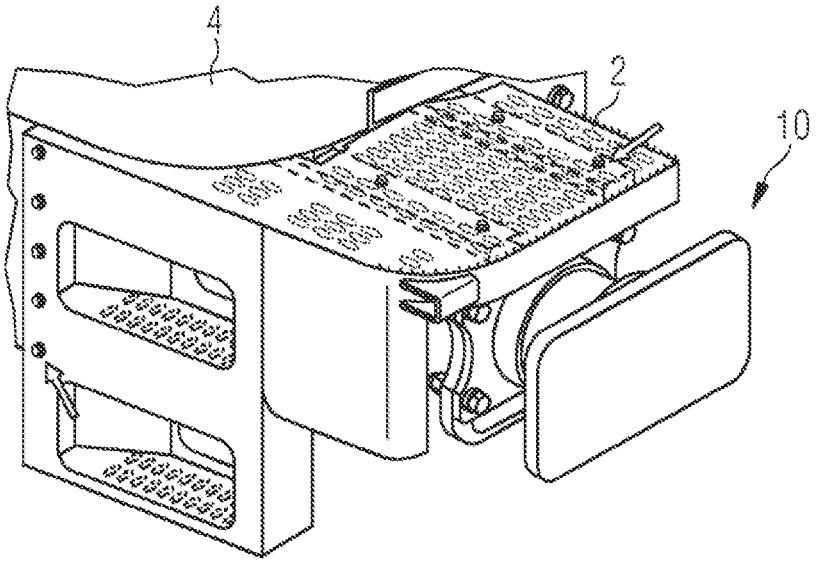
FIG 2 PRIOR ART
FIG. 2 shows an attachment of supporting components in the region of a buffer of a rail vehicle according to the prior art.
Figure 3:
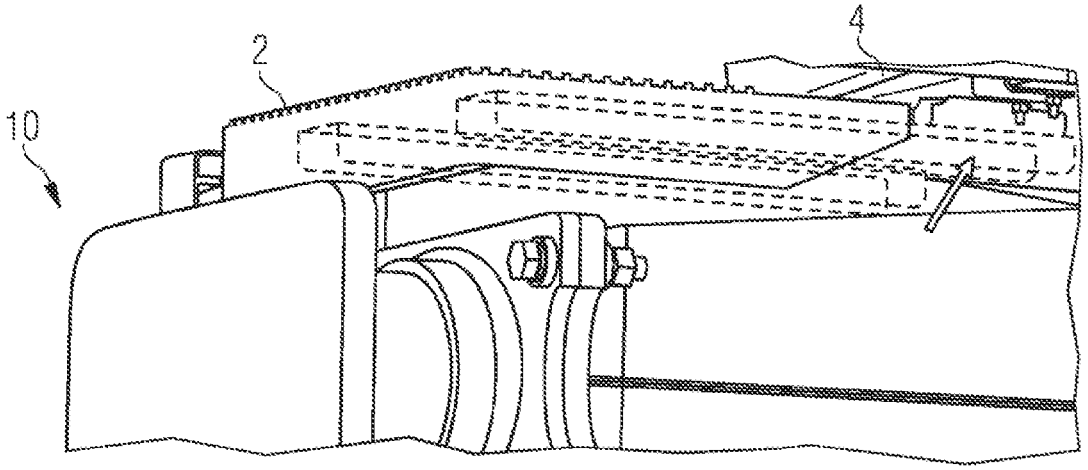
FIG 3 PRIOR ART
FIG. 3 shows FIG. 2 viewed at a different angle.

FIGS. 2 and 3 show an attachment of supporting components 2 to a buffer 10 of a rail vehicle 4 according to the prior art. The arrows point toward the regions of the rail vehicle 4 to which the supporting components 2 are fastened. A footplate 2 serves as an example of a supporting component 2 here. However, this could also be a handle or a switchman's platform. The footplate 2 shown here is fastened in the front-end region of the rail vehicle 4. The footplate 2 is fastened to the front plate of the undercarriage of the rail vehicle and to the side of the car body of the latter, as is referenced more specifically by the arrows. Owing to the rather large width of the footplate, the fastenings here are of a comparatively massive dimension so as to ensure a minor elastic deformation.

Figure 4:
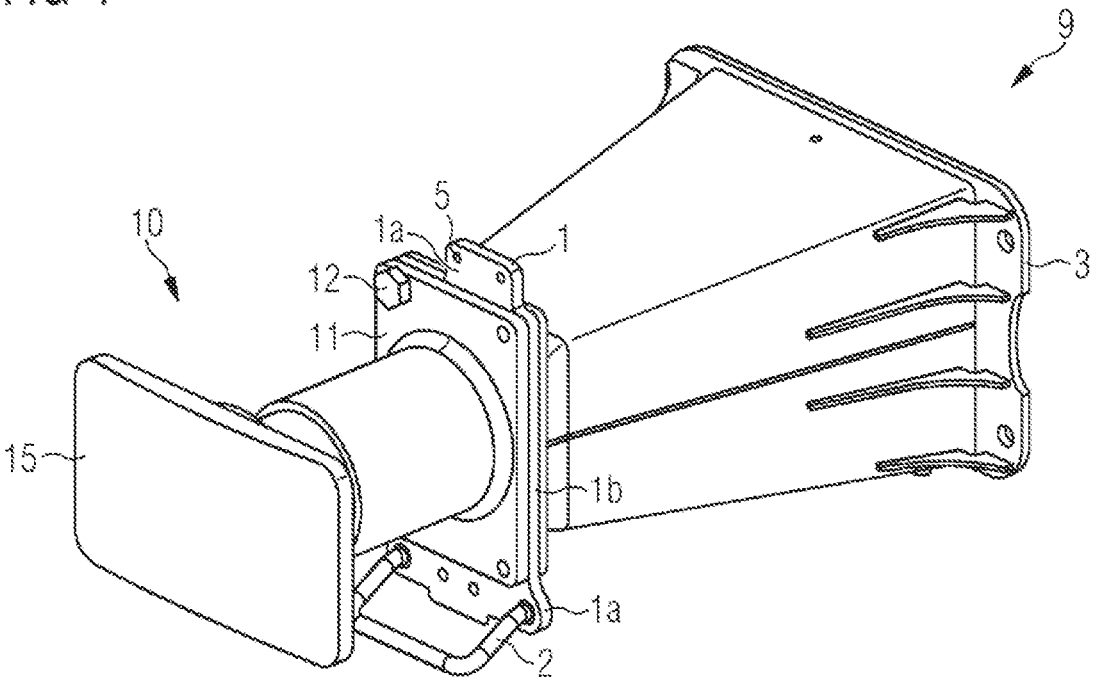
FIG. 4 shows an exemplary embodiment of a buffer system according to the invention having a preferred mounting interface.

FIG. 4 shows a preferred buffer system 9 having an exemplary embodiment for a mounting interface 1 according to the invention, to which is attached a footplate 2 or a handle as a supporting component 2. The buffer system 9 comprises a buffer 10 with a buffer flange 11 which is assembled on a crash element 3 as is shown in FIG. 1, for example. As opposed to FIG. 1, the buffer system 9 according to the invention comprises between the buffer 10 and the crash element 3 a mounting interface 1 according to the invention, wherein the components are connected to one another by means of buffer screws 12.

The mounting interface 1 here has a mounting body 1 (and in this example is fundamentally composed of this mounting body). This mounting body 1 here has two mutually separate component-fastening regions 1*a*, i.e. one upper and one lower, to which the footplate 2 is also attached. The attachment region 1*b*, which here has the same shape as the buffer flange 11, is situated between these component-fastening regions 1*a*. The component-fastening region 1*a* here is equipped with bores 5 (of which only one is provided with a reference sign for reasons of clarity), whereby screws instead of the bores 5 could also be present in the component-fastening region 1*a*. The attachment region 1*b* can be attached between the crash element 3 and the buffer flange 11 with all four buffer screws 12, so that these buffer screws 12 connect the crash element 3 and the buffer flange 11 conjointly with the intervening mounting interface 1 to the buffer system 9.

Figure 5:
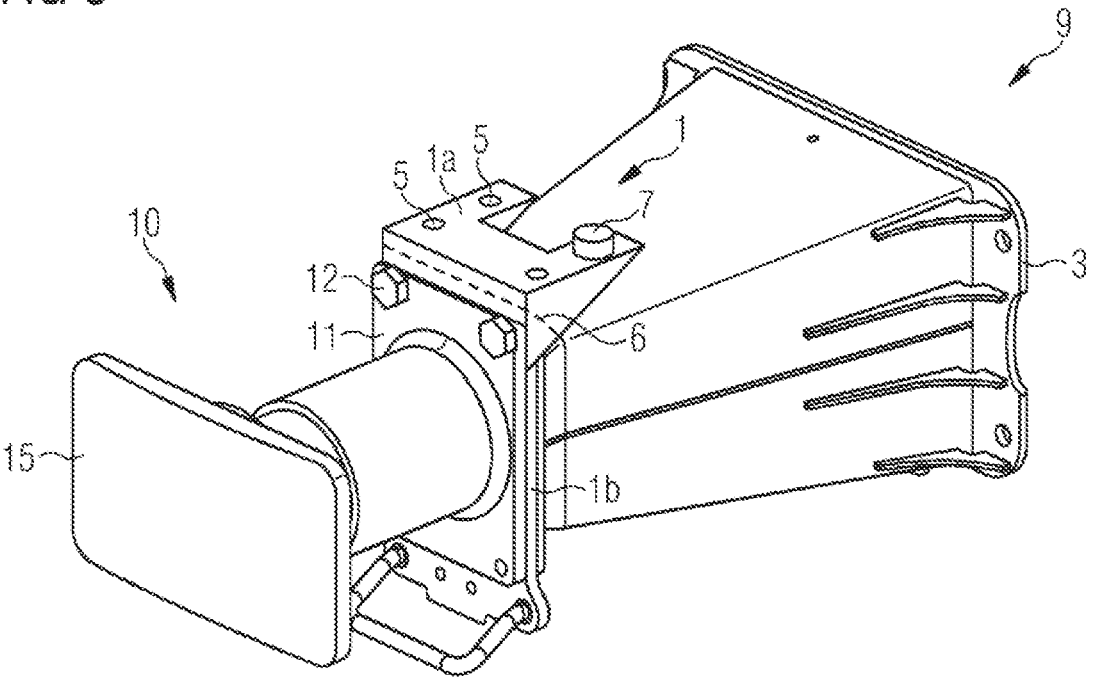
FIG. 5 shows a further exemplary embodiment of a buffer system according to the invention having an angled component-fastening region and a perforation.

FIG. 5 shows a further exemplary embodiment of a buffer system 9 according to the invention, which corresponds to that of FIG. 4. As opposed to FIG. 4, the component-fastening region 1*a* here is angled orthogonally relative to the attachment region 1*b*, so that a footplate 2 (not illustrated here) can be placed thereon and fastened in the bores of the component-fastening region 1*a* with screws 7.

In order to maintain optimal functioning of the crash element 3, specifically the optimal deformability of the latter in the event of an accident, the mounting interface 1 here has weakenings 6 in the form of a perforation so that the component-fastening region 1*a* is torn away from the attachment region 1*b* exactly at this location.

It is finally pointed out once again that the embodiments described in detail above are merely exemplary embodiments which can be modified in the most varied way by the person skilled in the art, without departing from the scope of the invention. Furthermore, the use of the indefinite article "a" does not preclude that the respective features may also be present in multiples. Likewise, terms such as "unit" do not preclude that the respective components are composed of a plurality of interacting sub-components which optionally may also be distributed in space.

The invention claimed is:

1. A mounting interface for attaching supporting components to a buffer of a rail vehicle, the mounting interface comprising:

a mounting body having a component-fastening region and an attachment region different from said component-fastening region;

said component-fastening region being equipped with fastening elements and/or bores for attaching the components; and said attachment region being shaped for fastening to a rear side of a buffer flange with buffer screws at two or more fastening points;

wherein said mounting body is formed with at least one weakening between said component-fastening region and said attachment region, said weakening being configured to separate said component-fastening region from said attachment region when a predetermined force acts on said weakening.

2. The mounting interface according to claim 1, wherein said attachment region has a shape that is the same as a shape of a predetermined buffer flange or at least a part of the predetermined buffer flange.

3. The mounting interface according to claim 1, wherein said attachment region is formed with a recess configured to encompass a buffer housing of a predetermined buffer.

4. The mounting interface according to claim 3, wherein said attachment region corresponds to a complete area of a buffer flange of a predetermined buffer with at least three bores for the buffer screws and having a recess where a buffer housing is situated on the buffer flange.

5. The mounting interface according to claim 1, wherein said attachment region is angled relative to said component-fastening region.

6. The mounting interface according to claim 5, wherein said attachment region extends orthogonally to said component-fastening region.

7. The mounting interface according to claim 1, wherein a fastening element is a bolt or a screw and said component-fastening region is fixedly attached to said mounting body, and/or wherein a bore in said component-fastening region is formed with a thread.

8. The mounting interface according to claim 1, further comprising fastening elements or bores in said component-fastening region for attaching further attachment parts.

9. The mounting interface according to claim 8, wherein the further attachment parts are configured for attaching at least one element selected from the group consisting of a coupler handle, a switchman's footplate, a switchman's platform, a maintenance platform, a railing, and a handlebar.

10. The mounting interface according to claim 1, wherein said weakening is a predetermined breaking point.

11. The mounting interface according to claim 10, wherein said weakening is a perforation or a shear-off element.

12. A rail vehicle, comprising a buffer system with a buffer having a buffer flange and a mounting interface according to claim 1 attached with buffer screws to a rear side of said buffer flange.

13. A buffer system, comprising:

a buffer having a buffer flange with a rear side; and a mounting interface according to claim 1 attached with buffer screws to said rear side of said buffer flange.

14. The buffer system according to claim 13, comprising a crash element attached with buffer screws to said buffer flange.

15. The buffer system according to claim 14, wherein said mounting interface is attached between said crash element and said buffer flange.

16. The buffer system according to claim 13, wherein said buffer is a center flange buffer.

17. The buffer system according to claim 13, wherein said attachment region of said mounting interface has the same shape as a shape of said buffer flange, and said attachment region and said buffer flange are formed with bores at corresponding locations, and wherein said mounting interface is fastened to said buffer flange by way of the buffer screws.

18. The buffer system according to claim 17, wherein said mounting interface is fastened between a crash element and said buffer flange.

19. The buffer system according to claim 13, wherein:

said attachment region of said mounting interface is formed with a recess configured to encompass a buffer housing at least partially.

20. The buffer system according to claim 19, wherein said attachment region corresponds to a complete area of said buffer flange, and said mounting interface is fastened to said buffer flange with at least three buffer screws.

* * * * *